US009133720B2

(12) United States Patent
Suciu et al.

(10) Patent No.: US 9,133,720 B2
(45) Date of Patent: Sep. 15, 2015

(54) INTEGRALLY BLADED ROTOR WITH SLOTTED OUTER RIM

(75) Inventors: Gabriel L. Suciu, Glastonbury, CT (US); James W. Norris, Lebanon, CT (US)

(73) Assignee: United Technologies Corporation, Hartford, CT (US)

( * ) Notice: Subject to any disclaimer, the term of this patent is extended or adjusted under 35 U.S.C. 154(b) by 2658 days.

(21) Appl. No.: 11/965,883

(22) Filed: Dec. 28, 2007

(65) Prior Publication Data

US 2011/0182745 A1 Jul. 28, 2011

(51) Int. Cl.

| | |
|---|---|
| ***F01D 5/34*** | (2006.01) |
| ***F01D 5/08*** | (2006.01) |
| ***F01D 11/00*** | (2006.01) |
| ***F04D 29/32*** | (2006.01) |

(52) U.S. Cl.

CPC *F01D 5/34* (2013.01); *F01D 5/084* (2013.01); *F01D 11/006* (2013.01); *F04D 29/322* (2013.01); *F04D 29/329* (2013.01); *F05D 2230/10* (2013.01); *F05D 2230/12* (2013.01); *F05D 2260/941* (2013.01)

(58) Field of Classification Search

CPC . F01D 5/10; F05D 2260/94; F05D 2260/941; F04D 29/329

USPC ..... 415/234, 241 R

See application file for complete search history.

(56) References Cited

U.S. PATENT DOCUMENTS

| | | | | |
|---|---|---|---|---|
| 737,042 | A | 8/1903 | Stumpf | |
| 2,623,727 | A | 12/1952 | McLeod | |
| 3,847,506 | A | 11/1974 | Straniti | |
| 3,897,171 | A * | 7/1975 | Stahl | 416/244 R |
| 4,813,848 | A | 3/1989 | Novotny | |
| 4,848,182 | A | 7/1989 | Novotny | |
| 4,873,751 | A | 10/1989 | Walker | |
| 5,113,583 | A | 5/1992 | Jenkel | |
| 5,257,909 | A | 11/1993 | Glynn | |
| 5,292,385 | A | 3/1994 | Kington | |
| 5,373,922 | A | 12/1994 | Marra | |
| 6,312,218 | B1 * | 11/2001 | Beeck et al. | 415/173.7 |
| 6,536,110 | B2 | 3/2003 | Smith | |
| 6,541,733 | B1 | 4/2003 | Mannava | |
| 6,787,740 | B2 | 9/2004 | Smith | |
| 6,881,036 | B2 | 4/2005 | Hornick | |
| 7,284,957 | B2 | 10/2007 | Hornick | |
| 2001/0019695 | A1 * | 9/2001 | Correia | 415/135 |
| 2006/0039791 | A1 | 2/2006 | Kim | |

(Continued)

FOREIGN PATENT DOCUMENTS

| | | |
|---|---|---|
| DE | 2442739 | 3/1976 |
| DE | 10361882 | 7/2005 |

(Continued)

OTHER PUBLICATIONS

European Search Report mailed Apr. 14, 2009.

(Continued)

*Primary Examiner* — Dwayne J White

*Assistant Examiner* — Adam W Brown

(74) *Attorney, Agent, or Firm* — Carlson, Gaskey & Olds, PC

(57) ABSTRACT

An integrally bladed rotor for a gas turbine engine includes at least one discontinuity formed in an outer face of an outer rim. The discontinuity reduces hoop stress in the outer rim.

6 Claims, 3 Drawing Sheets

(56) References Cited

U.S. PATENT DOCUMENTS

| | | | |
|---|---|---|---|
| 2006/0099078 | A1 | 5/2006 | Rice et al. |
| 2008/0304972 | A1 | 12/2008 | Xiao |
| 2010/0239422 | A1 | 9/2010 | Reyes et al. |

FOREIGN PATENT DOCUMENTS

| | | |
|---|---|---|
| EP | 2000631 | 12/2008 |
| GB | 2130927 | 6/1984 |
| GB | 1458524 | 4/2009 |

OTHER PUBLICATIONS

International Preliminary Report on Patentability for PCT Application No. PCT/US2013/053752 mailed on Feb. 26, 2015.
International Search Report and Written Opinion for International Application No. PCT/US2013/053752 completed on Jul. 17, 2014.

* cited by examiner

INTEGRALLY BLADED ROTOR WITH SLOTTED OUTER RIM

BACKGROUND OF THE INVENTION

This application relates to an integrally bladed rotor, such as utilized in gas turbine engines, wherein an outer rim has a discontinuity.

Gas turbine engines typically include a plurality of sections mounted in series. A fan section may deliver air to a compressor section. The compressor section may include high and low compression stages, and delivers compressed air to a combustion section. The air is mixed with fuel in the combustion section and burned. Products of this combustion are passed downstream over turbine rotors.

The compressor section includes a plurality of rotors having a plurality of circumferentially spaced blades. Recently, these rotors and blades have been formed as an integral component, called an "integrally bladed rotor."

In one known integrally bladed rotor, blades extend from an outer rim. The outer rim in integrally bladed rotors is subject to a number of stresses, and in particular, hoop stresses. The hoop stresses can cause the life of the integrally bladed rotor to be reduced due to thermal fatigue.

SUMMARY OF THE INVENTION

In the disclosed embodiment of this invention, discontinuities are formed in the outer rim of an integrally bladed rotor. In the disclosed embodiment, the discontinuity extends through the entire axial and radial width of the outer rim.

These and other features of the present invention can be best understood from the following specification and drawings, the following of which is a brief description.

DETAILED DESCRIPTION OF THE PREFERRED EMBODIMENTS

Figure 1:
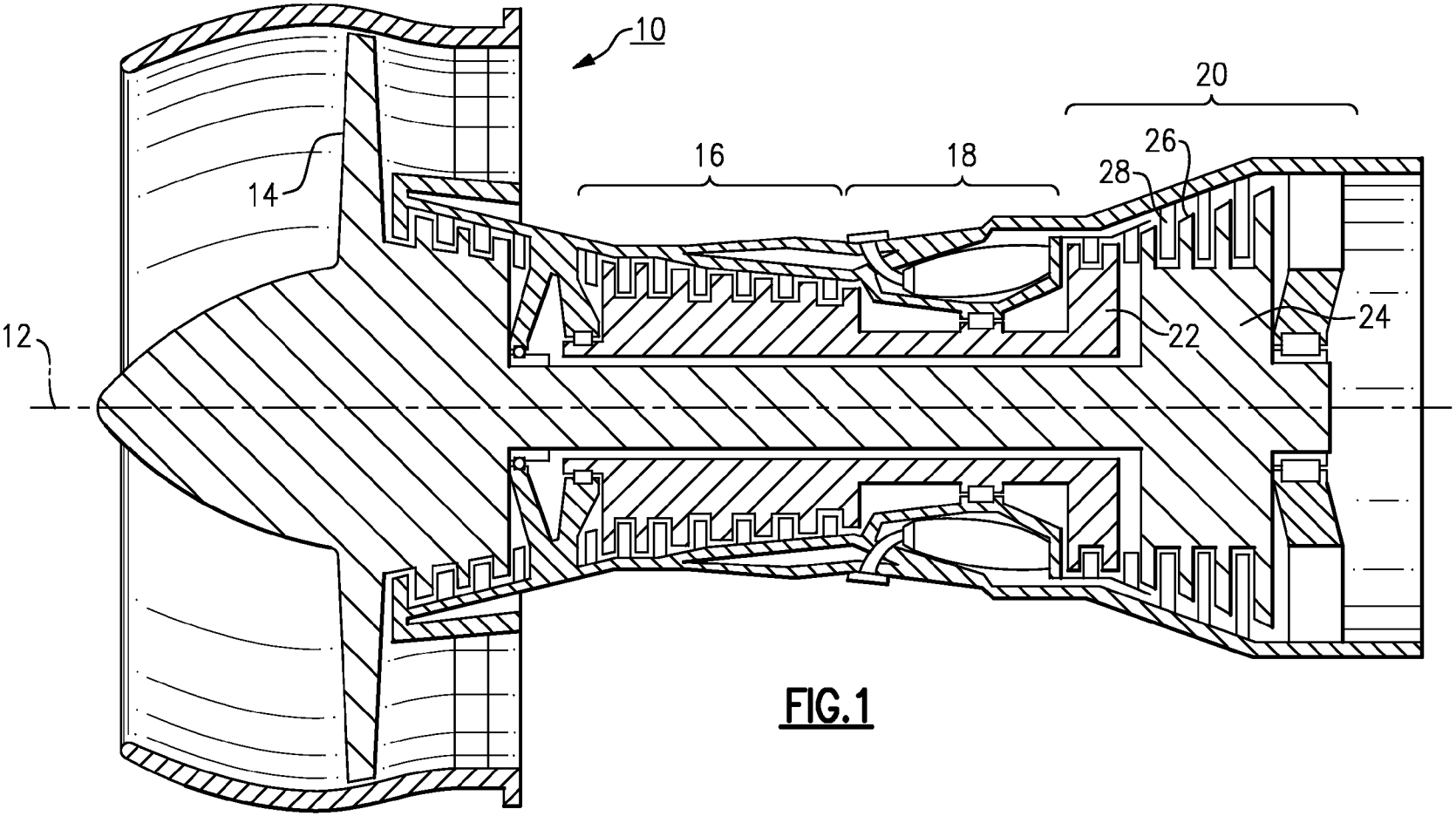
FIG. 1 schematically shows a gas turbine engine.

FIG. 1 shows a gas turbine engine 10. As known, a fan section 14 moves air and rotates about an axial center line 12. A compressor section 16, a combustion section 18, and a turbine section 20 are also centered on the axial center line 12. FIG. 1 is a highly schematic view; however, it does show the main components of the gas turbine engine. Further, while a particular type of gas turbine engine is illustrated in FIG. 1, it should be understood that the present invention extends to other types of gas turbine engines.

Figure 2:
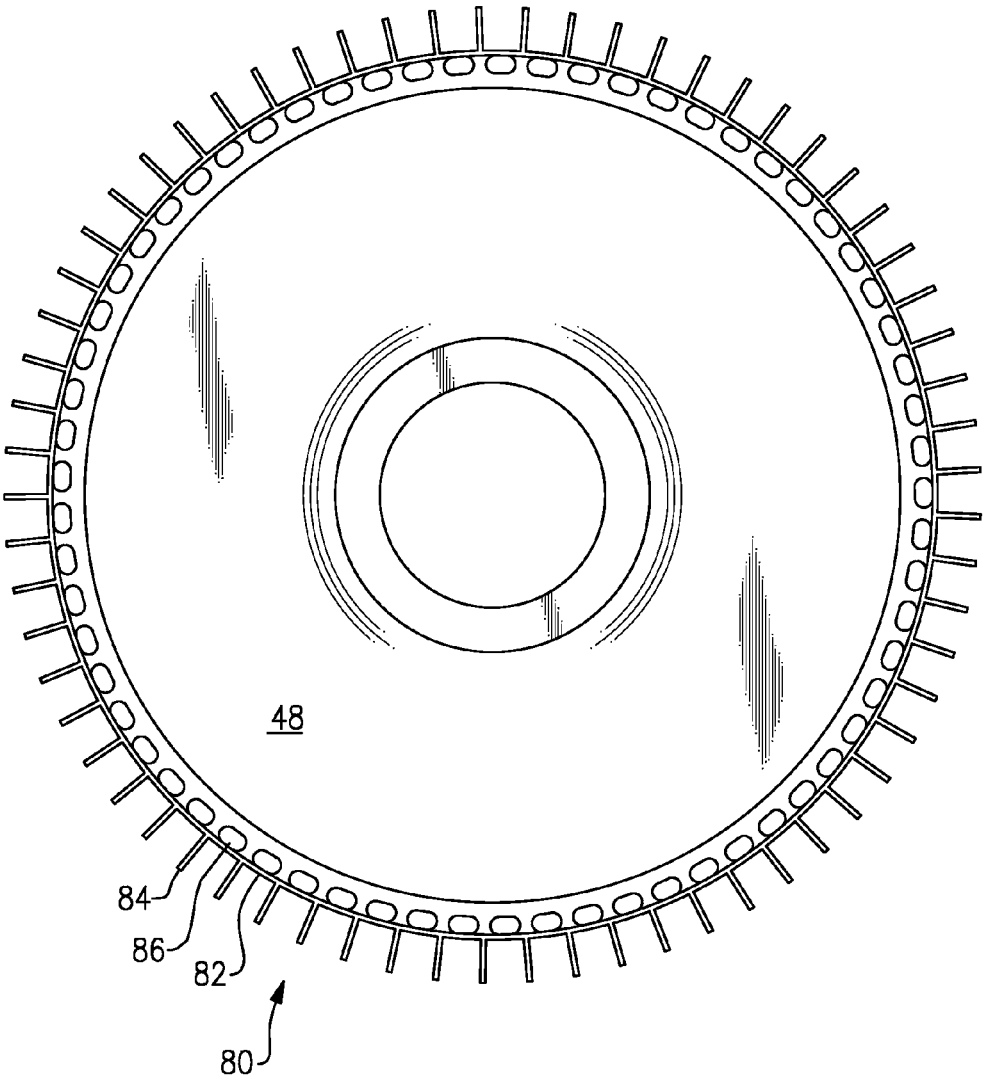
FIG. 2 shows an integrally bladed rotor according to an embodiment of the present invention.

FIG. 2 shows an integrally bladed rotor 80, such as may be utilized for the high stage compression section. The integrally bladed rotor 80 includes an outer rim 82, a plurality of circumferentially distributed blades 84, a central hub 48, and a plurality of channels 86. The channels 86 extend through the axial width of the rotor 80. Channels 86 and discontinuities 88, 90 and 92 (see FIGS. 3 and 4) address the hoop stresses discussed earlier.

Figure 3:
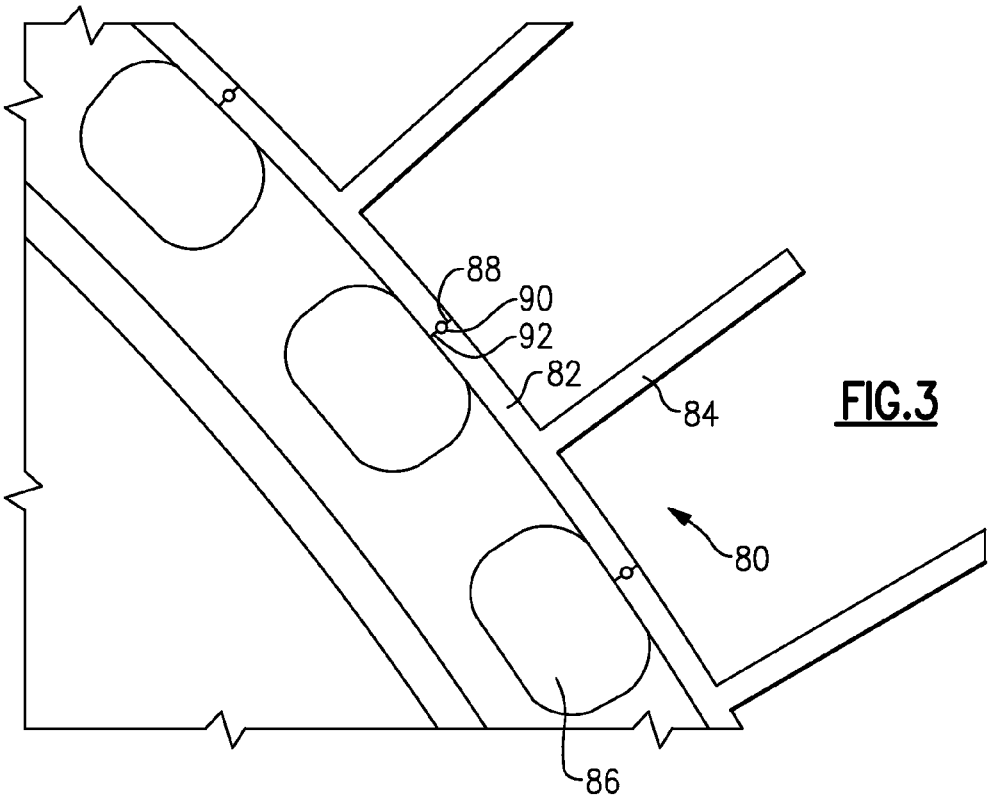
FIG. 3 shows a detail of the inventive integrally bladed rotor.

FIG. 3 shows integrally bladed rotor 80. In integrally bladed rotor 80, a discontinuity 88, 90, 92 is formed through a radial extent of the outer rim 82. As shown, a central enlarged, seal holding portion 90 is formed between two smaller slots 88 and 92. As can be appreciated, the radially inner slot 92 extends to the channel 86. As is clear, the slots 88 and 92 extend for a thinner circumferential extent than does the seal holding portion 90.

Figure 4:
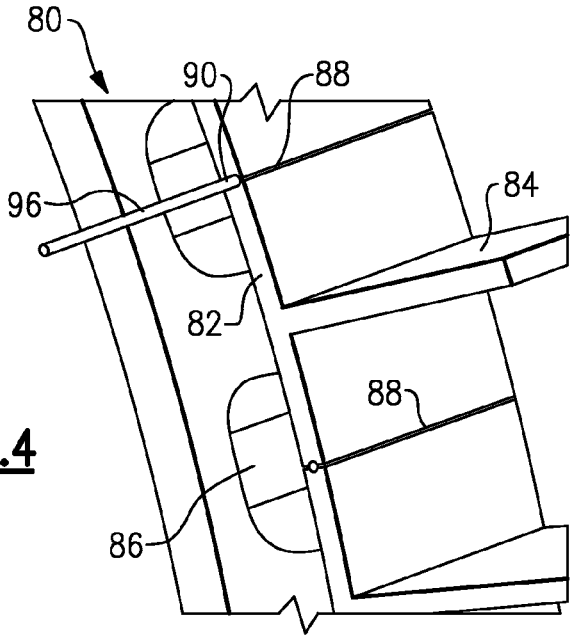
FIG. 4 is a perspective view of the FIG. 3 integrally bladed rotor.

As shown in FIG. 4, the outer slot 88 extends across the axial width of the rotor 80. Seals 96 may be inserted in the enlarged portion 90 of the discontinuity. The seal 96 is shown as a wire seal, however, other seals, such as brush seals or W seals, may be utilized. The seals prevent recirculation of gases from the radially outer face of the outer rim 82 into the channels 86.

As is clear from FIG. 4, the seal material is inserted into the seal holding portion 90, and not into the slots 88 and 92. In addition, the channel 86 does not receive the seal material.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. An integrally bladed rotor comprising:

an outer rim having a plurality of blades extending radially outwardly of said outer rim;

a discontinuity formed at a radially outer surface of said outer rim; and said discontinuity extending across an entire axial width of said outer rim, and entirely through a radial extent of said outer rim, a plurality of channels being formed radially inwardly of said outer rim, and extending through an axial width of said integrally bladed rotor, and said discontinuity extending from said radially outer face of said outer rim inwardly into at least one of said channels, and a seal being included within said discontinuity.

2. The integrally bladed rotor as set forth in claim 1, wherein said discontinuity includes a first thin slot at a radially outer face of said outer rim, an enlarged seal holding area, and a second thin slot positioned radially inwardly of said seal holding area, with said seal inserted into said seal holding area, said first and second thin slots being thinner circumferentially than said enlarged seal holding area.

3. The integrally bladed rotor as set forth in claim 1, wherein there are a plurality of discontinuities, with one formed between each adjacent pair of said blades.

4. A gas turbine engine comprising:

a compressor section including at least one rotor having a plurality of blades with said at least one rotor being an integrally bladed rotor;

said compressor for delivering compressed air downstream into a combustion section, said combustion section for delivering products of combustion downstream across a turbine rotor;

said integrally bladed rotor of said compression section including an outer rim having a plurality of blades extending radially outwardly of said outer rim, a discontinuity being formed at a radially outer surface of said outer rim; and said discontinuity extending across an entire axial width of said outer rim, and entirely through a radial extent of said outer rim, a plurality of channels being formed radially inwardly of said outer rim, and extending through an axial width of said integrally bladed rotor, and said discontinuity extending from said radially outer face of said outer rim inwardly into at least one of said channels, and a seal being included within said discontinuity.

5. The gas turbine engine as set forth in claim 4, wherein said discontinuity includes a first thin slot at said radially outer face of said outer rim, and enlarged seal holding area, and a second thin slot positioned radially inwardly of said seal holding area, with said seal inserted into said seal holding area, said first and second thin slots being thinner circumferentially than said enlarged seal holding area.

6. The gas turbine engine as set forth in claim 4, wherein there are a plurality of discontinuities, with one formed between each adjacent pair of said blades.

* * * * *